United States Patent [19]

Gottlob

[11] Patent Number: 4,457,274

[45] Date of Patent: Jul. 3, 1984

[54] OIL PAN ASSEMBLY

[75] Inventor: Clifford E. Gottlob, Arkansas City, Kans.

[73] Assignee: Gottlob Engine Conversions, Inc., Arkansas City, Kans.

[21] Appl. No.: 315,300

[22] Filed: Oct. 23, 1981

[51] Int. Cl.[3] ..... F01M 11/06

[52] U.S. Cl. ..... 123/195 C; 123/196 R

[58] Field of Search ..... 123/195 R, 195 C, 198 E, 123/196 R, 196 AB; 184/6.5, 106

[56] References Cited

U.S. PATENT DOCUMENTS

| | | | |
|---|---|---|---|
| 747,767 | 1/1903 | Renault | 123/196 R |
| 1,989,816 | 3/1935 | Meyer | 123/196 R |
| 2,837,075 | 6/1958 | Leach | 123/195 C |
| 3,724,599 | 5/1973 | Heidacker | 123/195 C |
| 4,068,646 | 6/1978 | Hnojsky | 123/195 C |
| 4,134,380 | 1/1979 | Niwa et al. | 123/196 R |
| 4,296,716 | 10/1981 | Hofbauer et al. | 123/195 C |

FOREIGN PATENT DOCUMENTS

| | | | |
|---|---|---|---|
| 2811144 | 10/1978 | Fed. Rep. of Germany | 184/6.5 |

OTHER PUBLICATIONS

Lang; Panning for Oil; Hot Rod Yearbook, No. 11; 1971; pp. 144–151.

*Primary Examiner*—Craig R. Feinberg

*Attorney, Agent, or Firm*—Irvin A. Lavine

[57] ABSTRACT

An oil pan for an automobile engine comprising an upwardly open pan having first and second bottoms located at different distances from an upper edge, and an auxiliary compartment pan beneath the bottom which is closer to the upper edge and joined to it; a wall extending between the two bottoms of the pan has an aperture communicating the oil pan and the auxiliary compartment.

9 Claims, 4 Drawing Figures

OIL PAN ASSEMBLY

TECHNICAL FIELD

The present invention relates to an oil pan assembly for internal combustion engines.

BACKGROUND ART

As part of a complete engine assembly, there is provided an oil pan beneath the engine block. Typically, the oil pan has a generally horizontal flange, depending walls, and a bottom. The oil pan is secured to the engine block, and contains lubricating oil for the engine.

A typical internal combustion engine oil pan was fabricated of a single piece of metal, and had side walls which were either vertical or slightly inwardly inclined, and also had front and rear walls which were either vertical or slightly inwardly inclined. Thus, the bottom of the oil pan was the same size, or slightly smaller than the flange of the oil pan which was used to secure the oil pan to the bottom of the engine block. Examples of such constructions are shown in Renault, U.S. Pat. No. 747,767 and Meyer, U.S. Pat. No. 1,989,816.

In later years, the oil pan was modified, having a first bottom which was at a relatively great distance from the flange, and a second bottom at a smaller distance from the flange; a wall extended between the two bottoms. As a result, there was provided at the rear a relatively deep well, and at the front, since the bottom was closer to the flange, the well was of lesser depth. Oil pan assemblies of the noted construction are disclosed in Heidacker, U.S. Pat. No. 3,724,599 and Hnojsky, U.S. Pat. No. 4,068,646. Such oil pans, having a relatively deep well at the rear and a relatively shallow well at the front are now widely used, and in many automotive engines, are provided as the standard oil pan construction.

These oil pans have a deficiency, however, that they are able to contain less oil pans of regular configuration, in which there was a single deep well.

Where it is desired, therefore, to provide an oil pan of greater capacity, where an existing engine is being modified or converted, the obtaining of an oil pan of suitable capacity presents substantial difficulties because of the fact that such oil pans are not available in the conventional automotive parts supply systems. Consequently, the problem of obtaining an oil pan of large capacity, for replacement of a conventional oil pan has existed without a satisfactory solution.

DISCLOSURE OF INVENTION

An oil pan assembly is provided having substantial additional capacity in comparison to a conventional oil pan. The oil pan assembly includes an oil pan and an auxiliary compartment pan secured to it. The oil pan has an upper edge defined by a horizontal flange, which is of rectangular configuration. The oil pan includes a first bottom which is spaced relatively far from the upper edge, and a second bottom which is spaced closer to the upper edge. An intermediate wall extends between and is joined to these bottoms. Extending upwardly from the first bottom are a pair of side walls and a rear wall, in addition to the intermediate wall. The two side walls have coplanar extensions which extend upwardly from the second bottom, to the flanged, upper edge, and also extend from the second bottom, between it and the flanged edge is a front wall.

The auxiliary compartment is located beneath the second bottom of the oil pan, and comprises an auxiliary compartment bottom which underlies the second bottom of the oil pan, being spaced therefrom, and being preferably coplanar with the first bottom of the oil pan. A front wall extends upwardly from the auxiliary compartment bottom, being substantially coplanar with the front wall of the oil pan, and having its upper edge joined to the lower portion of the front wall of the oil pan. Similarly, a pair of side walls extend upwardly from the auxiliary compartment bottom, having upper and rear edges which are joined to the lower portions of the side walls extending from the second bottom of the oil pan and to the front portions of the side walls extending from the first bottom of the oil pan, respectively. The auxiliary compartment structure is joined, as above set forth, to the oil pan by suitable means, such as welding, to thereby form with the oil pan a structure which is capable of holding a liquid, such as a lubricating oil. The intermediate wall of the oil pan is modified to provide one or more passages so as to connect the space above the first bottom and the space above the auxiliary compartment bottom.

The herein above described assembly may be manufactured from a standard oil pan, and from an auxiliary compartment, which latter may be readily fabricated, since it is of simple construction and does not require an out-turned flange to cooperate with the engine block.

BEST MODE FOR CARRYING OUT THE INVENTION

Figure 1:
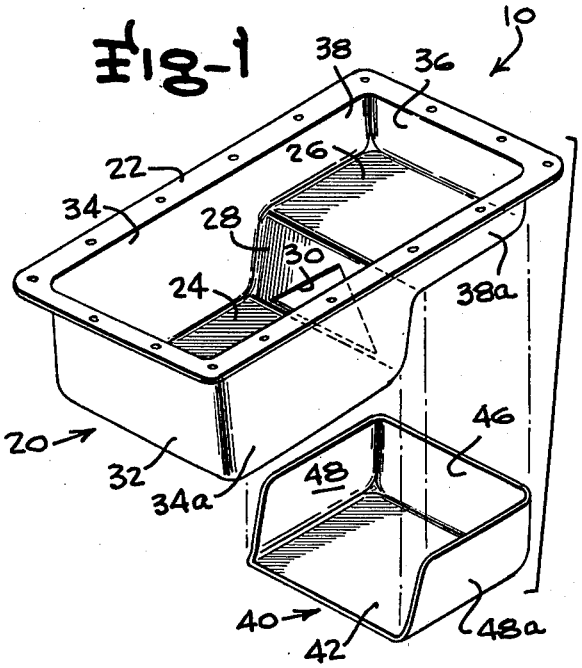
FIG. 1 is a perspective, exploded view of an oil pan assembly in accordance with the present invention.

Referring now to the drawings, wherein like or corresponding reference numerals are used to designate like or corresponding parts throughout the several views, there is shown in FIG. 1 an oil pan assembly 10, comprising an oil pan 20, and an auxiliary compartment 40. Oil pan 20 comprises a horizontal flange 22 which is of generally rectangular shape in plan view so as to engage the bottom surface an engine block, in known fashion. The flange 22 provides a planar upper edge of the oil pan 20. A first bottom 24 is provided, being located relatively far from the flange 22, and a second bottom 26 is provided, located relatively closer to the flange 22. An intermediate wall 28 extends between and connects the bottoms 24 and 26, and has a communicating opening 30 therethrough.

Extending upwardly from the first bottom 24 are peripheral walls, including a rear wall 32, which is joined to or integral with the first bottom 24 and with the flange 22. Side walls 34, **34*a* are provided, which comprise a first set of side walls and extend upwardly from the first bottom 24 and are joined to the flange 22. Extending upwardly from the second bottom 26 are a front wall 36, and a pair of side walls 38 and 38*a*, the latter being a second set of side walls and being coplanar with the side walls 34 and 34*a*, respectively. The peripheral walls 34, 34*a*, 38, 38*a*, 32 and 36 depend from the flange 32**.

The auxiliary compartment 40 comprises an auxiliary bottom 42, extending upwardly from which is a front wall 46, and side walls 48 and 48*a*.

Figure 2:
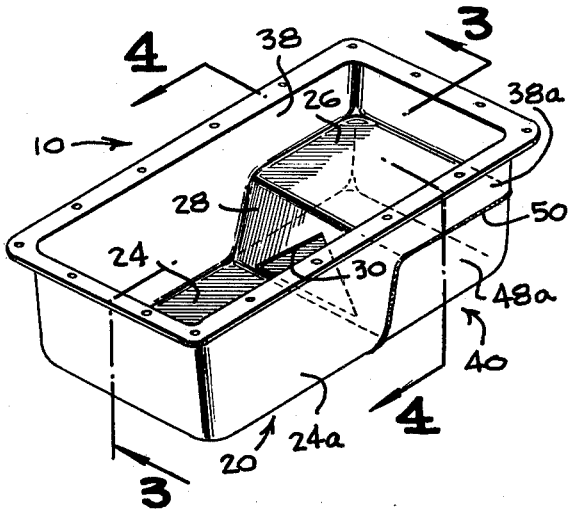
FIG. 2 is a perspective view, similar to FIG. 1, with the parts in assembled relationship.

Referring now to FIG. 2, there is shown the oil pan assembly 10, with the compartment 40 joined to the oil pan 20, the joining being effected by means such as welding at the meeting edges so as to provide a structure which will contain liquid, such as lubricating oil, therewithin.

Figure 3:
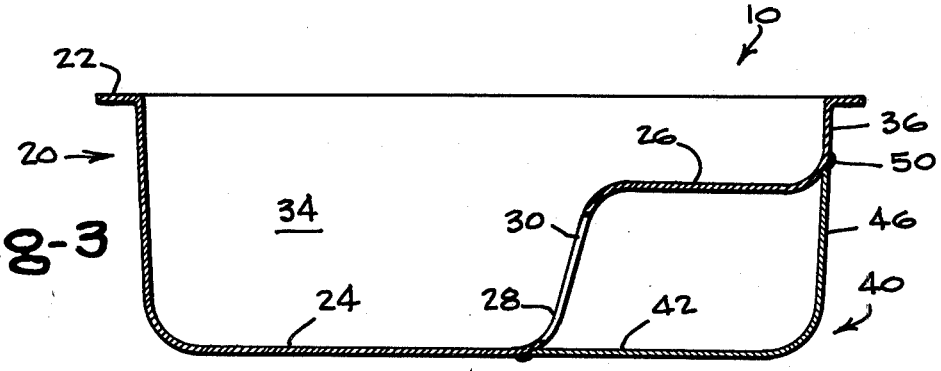
FIG. 3 is a cross-sectional view taken on the line 3—3 of FIG. 2.

Referring to FIG. 3, there may be seen the oil pan 20 having the auxiliary compartment 40 assembled to it. The auxiliary compartment bottom 42 will be seen to be coplanar with the first bottom 24, and to lie beneath the second bottom 26. Weld 50 is shown, located at the upper edge of the front wall 46, joining it to the lower portion of the front wall 36. There may also be seen the intermediate wall 28 extending between the first bottom 24 and the second bottom 26, and having the opening 30 therein to provide communication between the relatively deep well provided above the first bottom 24 and the compartment which lies above the auxiliary bottom 42. The front wall 36 is preferably coplanar with the front wall 46.

Figure 4:
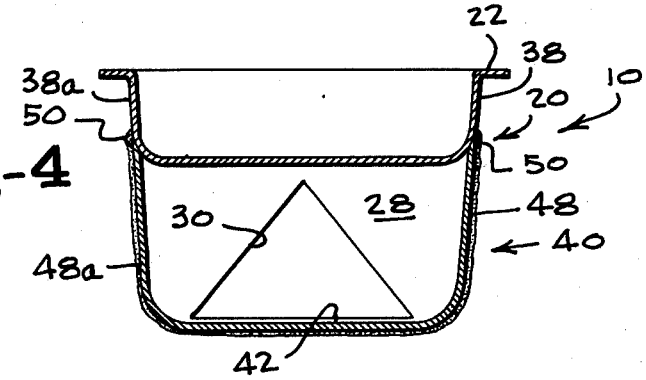
FIG. 4 is a cross-sectional view taken on the line 4—4 of FIG. 2.

Referring now to FIG. 4, there is shown the oil pan assembly 10, and in particular the spaced side walls 38 and 38*a* of the oil pan 20, and the spaced side walls 48 and 48*a* of the auxiliary compartment 40. The side wall 48 is substantially coplanar with the side wall 38, and similarly, the side wall 48*a* is substantially coplanar with the side wall 38*a*. Weld 50 will be seen to connect the upper edges of the side walls 48 and 48*a* with the lower portions of the side walls 38 and 38*a*, respectively.

As is apparent from FIG. 2, the side wall 38*a* is of lower height than the side wall 34*a* and forms an extension of it, as well as being coplanar with it. The side wall 48*a* of the auxiliary compartment 40 is coplanar with both the side wall 38*a* and the side wall 34*a*. A similar construction is present in connection side walls 38, 48 and 34.

There has been provided an oil pan assembly which substantially increases the volume or capacity of a conventional oil pan, the oil pan assembly including a readily available oil pan of somewhat complex construction, requiring equipment for fabrication such as heavy presses, and further including an auxiliary compartment which may be produced readily, and without the requirement of heavy equipment. The auxiliary compartment may be produced from readily available material, fabricated from conventional equipment, such as conventional welding equipment. The herein disclosed oil pan assembly utilizes the flange of the oil pan, thereby avoiding the fabrication of an additional flange structure, or the joining of an additional flange structure to an existing flange structure. The opening 30 is constantly open, providing passage for oil between the oil pan and auxiliary compartment independent of temperature.

It will be obvious to those skilled in the art that various changes may be made without departing from the spirit of the invention and therefore the invention is not limited to what is shown in the drawings and described in the specification but only as indicated in the appended claims.

I claim:

1. An oil pan assembly for an internal combustion engine comprising:

(a) an upwardly open pan having a planar upper edge, peripheral wall means depending therefrom, first and second bottoms extending from said peripheral wall means, said first bottom located relatively far from said edge and said second bottom located relatively close to said edge, and an intermediate wall means extending between and connecting said bottoms, (b) means defining an auxiliary compartment beneath said second bottom and comprising an auxiliary bottom, underlying said second bottom and spaced therefrom, and auxiliary peripheral wall means extending from said auxiliary bottom to said pan, (c) weld means joining said auxiliary compartment means to said pan at edges of said auxiliary peripheral wall means and said auxiliary bottom of said auxiliary compartment means, and (d) constantly open passage means in said intermediate wall means extending between said first and second bottoms of said pan for continuously communicating said auxiliary compartment with said pan independent of temperature.

2. The oil pan assembly of claim 1, said upper edge being generally rectangular.

3. The oil pan assembly of claim 1, said auxiliary bottom being substantially coplanar with said first bottom.

4. The oil pan assembly of claims 1 or 3, wherein wall means of said auxiliary compartment defining means are substantially coplanar with wall means of said oil pan.

5. The oil pan assembly of claims 1 or 3, said first bottom being rectangular, said peripheral wall means of said open pan comprising a first set of side walls and a rear wall of equal height extending from said first bottom to said upper edge, said intermediate wall means extending between said first and second bottoms and being of lesser height than said side and rear walls.

6. The oil pan assembly of claim 5, said peripheral wall means of said open pan comprising a second set of side walls and a front wall of equal height extending from said second bottom to said upper edge, said second set of side walls being coplanar with said first set of side walls and integral therewith.

7. The oil pan assembly of claim 5, wherein said auxiliary peripheral wall means of said auxiliary compartment means comprises side walls coplanar with said second set of side wall of said open pan and having upper portions of said auxiliary peripheral wall means joined to a lower portion of said second set of side walls which extend to said second bottom.

8. The oil pan assembly of claim 7, wherein said auxiliary compartment means comprise a front wall and edges of said side walls of said auxiliary compartment means remote from said front wall are joined to the first set of side walls of said open pan adjacent said intermediate wall means extending between said bottoms.

9. The oil pan assembly of claim 8, where said peripheral wall means of said oil pan comprises a front wall coplanar with said front wall of said auxiliary compartment means.

* * * * *